US005334449A

United States Patent [19]

Bergmann et al.

[11] Patent Number: 5,334,449

[45] Date of Patent: Aug. 2, 1994

[54] COATED PAPER

[75] Inventors: Werner Bergmann, Brüggen; Paul H. Dähling, Elsdorf - Esch, both of Fed. Rep. of Germany

[73] Assignee: Stora Feldmühle Aktiengesellschaft, Dusseldorf, Fed. Rep. of Germany

[21] Appl. No.: 980,800

[22] PCT Filed: Aug. 27, 1991

[86] PCT No.: PCT/EP91/01629

§ 371 Date: Feb. 25, 1993

§ 102(e) Date: Feb. 25, 1993

[87] PCT Pub. No.: WO92/05312

PCT Pub. Date: Apr. 2, 1992

[30] Foreign Application Priority Data

Sep. 18, 1990 [DE] Fed. Rep. of Germany ..... 4029491

[51] Int. Cl.[5] ..... B32B 9/00

[52] U.S. Cl. ..... 428/327; 428/454; 428/537.5

[58] Field of Search ..... 428/327, 454, 537.5

[56] References Cited

U.S. PATENT DOCUMENTS

| | | | |
|---|---|---|---|
| 3,113,888 | 12/1963 | Gold et al. | 117/71 |
| 3,463,659 | 8/1969 | Dragoon et al. | 428/454 |
| 3,963,820 | 6/1976 | Blakey | 264/134 |
| 4,469,749 | 9/1984 | Schwarz | 428/403 |
| 4,556,527 | 12/1985 | Sarcander | 264/171 |
| 4,567,098 | 1/1986 | Becker et al. | 428/327 |

FOREIGN PATENT DOCUMENTS 1124086 8/1968 United Kingdom .

*Primary Examiner*—Patrick J. Ryan
*Assistant Examiner*—Kam F. Lee
*Attorney, Agent, or Firm*—Felfe & Lynch

[57] ABSTRACT

In the abstract No. 75-35061W of the WPI, Week 7521, Derwent P. L. London (citing JP-A-118906/1974) there is disclosed a paper with a cover coat applied by the cast coating process, for whose preparation first a prime coat is applied whose pigment composition consists of 30 wt. % of kaolin and 60 wt. % of a polystyrene pigment, and whose binding agent composition includes 10 weight-parts casein and 16 weight-parts of a carboxylated butadiene-styrene latex. After this prime coat has dried a mixture of 80 weight-parts of kaolin, 20 weight-parts of calcium carbonate, 10 weight-parts of casein and 8 weight-parts of a butadiene-styrene latex is applied and the applied composition is pressed at a temperature of 90° C. against a chrome-lacquered surface.

11 Claims, No Drawings

COATED PAPER

The present invention relates to a paper coated on one side, a method for its manufacture, and its use.

In the state of the art, cast coated papers of good surface smoothness and high gloss have long been known. DE-B-1233248 describes a cast coating process in which a coating composition containing a metallic pigment and organic binding agent is for example applied to a paper web and dried in contact with a heated high-gloss cylinder.

For the production of papers with a high metallic gloss, coatings have already been proposed which are produced by precipitating metal vapors produced in a high vacuum onto papers provided with special coatings.

According to U.S. Pat. No. 3,113,888, a paper with a coating produced by the cast coating process is used. The coating consists of a synthetic resin binding agent which is not film-forming at normal temperature, whose particles have a melting point between 71° and 99° C. If desired, the coating can be applied onto a base coating which contains one of the common synthetic resin binding agents in addition to a filler. A part of the synthetic resin binding agent to be used in the base coating can also be replaced with natural binding agents, so that 10 to 30 wt. % of the total binding agent content in the base coating consists, for example, of starch, modified starch, methyl cellulose, carboxymethyl cellulose, hydroxyethyl cellulose and similar substances.

For the preparation of the coating to be metalized, the so-called "direct method," as described above regarding DE-B-1233248, is given and also the "indirect method," in which the coating composition is applied to the high-gloss cylinder and before it is dried the dry paper is brought into contact with the still wet film, the latter being absorbed by the paper and drawn from the drum.

In the process disclosed in DE-B-2310891 it is not the cast coating process (also called "direct method") disclosed in DE-A-1233248 that is involved. Instead, with simultaneous formation of a continuous film from the polymer contained in the coating composition, first part of the water is evaporated and the film that is formed is finished against a high-gloss cylinder at a temperature above 100° C. under a minimum pressure of 5 kp/cm$^2$. To keep the film from sticking to the high-gloss cylinder during the shaping that occurs under pressure, a stick-reducing agent can be added up to an amount below 30%. Sodium carboxymethyl cellulose, methyl cellulose, polyvinyl alcohol and polyvinyl pyrrolidone are proposed among other substances for this purpose, in amounts up to 10% of the weight of the main polymer. Provided as the base coating are the common preliminary coatings used in papermaking, with and without the addition of pigments.

EP-B-98368 discloses a metalized paper in which the coating provided for the metalizing is formed under conditions similar to those stated in DE-B-2310891. The coating composition contains 5 to 25 parts by weight of film-forming binding agent per 100 weight-parts of pigment, and thus has the pigment-to-binding agent ratio of conventional paper coatings. The difference from the other paper coatings, however, is the addition of a synthetic polymer pigment, which is added in an amount of 5 to 100 wt. % of the total pigment content. By this proposal the previously existing disadvantage is said to be eliminated, which consisted in the fact that the coating surface provided for metalizing first had to be provided with a preliminary lacquering on the basis of organic solvents. However, even the proposal of EP-B-98368 is not free of disadvantages, either, because the coating to be metalized must be produced in a minimum amount of 10 g/m$^2$, preferably with an applied weight of 18 to 26 g/m$^2$. Another disadvantage is the high costs of the synthetic polymer pigment.

In the abstract No. 75-35061W of the WPI, Week 7521, Derwent P. L. London (citing JP-A-118906/1974) there is disclosed a paper with a cover coat applied by the cast coating process, for whose preparation first a prime coat is applied whose pigment composition consists of 30 wt. % of kaolin and 60 wt. % of a polystyrene pigment, and whose binding agent composition includes 10 weight-parts casein and 16 weight-parts of a carboxylated butadiene-styrene latex. After this prime coat has dried a mixture of 80 weight-parts of kaolin, 20 weight-parts of calcium carbonate, 10 weight-parts of casein and 8 weight-parts of a butadiene-styrene latex is applied and the applied composition is pressed at a temperature of 90° C. against a chrome-lacquered surface.

The object of the present invention consists in making available, by resorting to low-cost raw coating materials, a paper provided on one side with a coating, which due to its high gloss and its smoothness is to be used wherever a decorative impression is desired. The invention sees a special object in the formation of a cover coating which permits a direct metalization of the paper, i.e., metalization without preliminary coating with a lacquer on a basis of organic solvents, so that the result will be a paper of maximum smoothness with a high gloss and a metallic appearance. Especially the invention is also to make available a paper which despite the action of water will show a high preservation of its gloss and therefore, even in the unmetalized state, will be suitable for the production of labels which can be adhered with water-based adhesives. In the metalized state the paper is to be printable by intaglio printing and offset printing, and in the unmetalized state by intaglio printing and flexoprinting as well as by offset printing—at least with special inks—and is to have good printing ink adhesion when subjected to mechanical action on the printed surface, even in the presence of water.

For the achievement of this object the present invention provides a paper coated on one side having:

a) a cover coating applied by the cast coating method, b) formed from a composition which consists of
   - a film forming synthetic resin binding agent and
   - a natural binding agent in an amount of 20 to 60 wt. % of the total binding agent content;

c) a calendered coating applied to the raw paper and carrying the cover coating,
   - which consists of one or two layers one over the other and
   - the layers are formed of a film-forming synthetic resin binding agent,
   - and/or natural binding agent
   - and a composition containing mineral pigment.

According to an additional embodiment, the composition for forming the cover coating additionally contains up to 5 wt. % of mineral pigment.

Data on the binding agent content relate to dry-weight percentages;

Data on the pigment content relate to the total binding agent content (dry-weight percentages) of the particular composition.

The invention also includes a process for the production of a high-gloss paper of great smoothness coated on one side, which can be directly metalized. For the performance of this process a raw paper is first given one or two coats (on one side) of a composition which consists of film-forming synthetic resin binding agent and/or natural binding agent and mineral pigment. The dried coating is then calendered. By means of coating apparatus known in themselves, a second composition is applied to this coating, which consists, in parts by dry weight, of a natural binding agent in an amount of 20 to 60 wt. % of the total binding agent content, and a film-forming synthetic resin binding agent. The applied coating is equalized and immediately thereafter delivered to a heated high-gloss cylinder and dried in contact with the latter, the cover coat forming into a continuous film of little porosity.

According to the invention, the process can also be performed by adding mineral pigment in an amount of up to 5 wt. % to the second composition. In this manner a cover coat of greater opacity is achieved, but one which under certain circumstances is obtained at the cost of less surface gloss and reduced surface smoothness. Operating without the addition of mineral pigment in preparing the cover coat is therefore especially preferred.

Since it has been found that the cover coat can be metalized directly, without preliminary lacquering, a paper in accordance with the invention is used preferably as a support for a vapor-deposited metal coating, especially for the production of labels which can be applied with aqueous adhesives, such as bottle labels, for example. Additional uses can be found by using the unmetalized paper also as a label to be applied with aqueous adhesives, or as decorative paper, metalized or unmetalized, for example as gift wrapping paper.

It follows from the description of the process given above that the term, "cast coating process" used in patent claims and in descriptions given in connection with the present invention refers only to a process in which the coating composition, immediately after it is applied to the support web, is brought in contact with a heated high-gloss cylinder; cf. DE-B-1233248 as well as the "direct method" described in U.S. Pat. No. 3,113,888.

The film-forming synthetic resin binding agents to be used in forming the cover coat have film-forming temperatures of less than 40° C., preferably even less than 30° C. and are used in the form of aqueous dispersions, preferably on the basis of the polymers and copolymers of acrylic acid esters, methacrylic acid esters, butadiene-styrene, vinyl acetate and vinylidene chloride. For the production of the layers forming the calendered coating applied to the raw paper and carrying the cover coat, preferably the same film-forming synthetic resin binding agents are used, but in some cases synthetic resin binding agents with a higher film-forming temperature may be used. Cellulose derivatives, such as carboxymethyl cellulose, hydroxyethyl cellulose, preferably casein and starch, modified starch, and mixtures of the natural binding agents named above serve as natural binding agents for the production of the coating and the cover coating.

In the coating applied to the raw paper the content of the natural binding agent is not more than 70 wt. %, and the range between 10 and 50 wt. %, each reckoned as dry-weight percentages of the total binding agent content, is very especially preferred.

The mineral pigment in the coating applied to the raw paper can be chalk, kaolin and titanium dioxide, the total binding agent percentage, reckoned as dry-weight percentages, is 10 to 20 wt. % of the pigment content. To improve the opacity of the paper titanium dioxide is used preferentially as mineral pigment for the cover coating. Better results as regards surface gloss and surface smoothness, however, are achieved in the cover coating without the use of mineral pigment, so that it is preferred to dispense with its use, especially when metalization of the paper is anticipated. In this case the cover coating is transparent and consists only of natural binding agent, synthetic resin binding agent and residual components of adjuvants which can be present in minor amounts in the composition for making the cover coating, such as for example agents to aid in the separation of the dried cover coating from the high-gloss cylinder, examples being calcium stearate or, in some cases, one or more of the usual thickening agents, but the amount of release agents and thickening adjuvants must not total more than 10% of the weight of the total binding agent content in the cover coating. A crosslinking adjuvant (wet-strength agent) can additionally be present in the cover coating.

On account of the percentage of natural binding agent always present in the cover coating, the paper in accordance with the invention can be manufactured very economically; preferably, the content of natural binding agent can be around 32 to 45% by weight. If there is more than 60 wt. % of natural binding agent the disadvantage is that the coating composition will have too little solid content and economy is threatened by the high cost of drying. There is also the danger that the moisture sensitivity of the cover coating, and with it the loss of gloss, will increase. The Bekk smoothness of the coating applied to the raw paper is at least around 150 s.

According to one preferred embodiment, the coating applied to the raw paper has a Bekk smoothness in the range from 500 to 3,000 s. To achieve such smoothness a coating with at least 5 g/m$^2$ of substance has proven necessary. A coating with 7 to 22 g/m$^2$ of substance has been found especially appropriate, but preferably with a substance content not exceeding 15 g/m$^2$. If such a coating is calendered, with a supercalender, for example, it offers an outstanding base for the following cover coating. Preferably the permeability to air, measured by the Gurley method, of the calendered paper is a lo maximum of 9,000 s per 100 ml of air. The cover coat is applied in a maximum up to 10 g/m2; according to a preferred embodiment in a weight per unit area of only 3 to 8 g/m$^2$, preferably up to 6 g/m$^2$. The application of the cover coat in such a low weight forms an additional economic advantage of the present invention. Preferably, the cover coat is formed with a gloss ranging from 88 to 98% (Lehmann method of gloss measurement at an angle of 75 degrees). The smoothness of the cover coat is so great that it cannot be measured by the usual Bekk method.

By the addition of small amounts of a wet-strength agent, preferably in the amount of 2 to 10 wt. % with respect to the dry weight parts of the total binding agent contained in the cover coat, the cover coat of the paper according to the invention has good gloss retention even under the action of water. This is especially important when the paper is made, for example, into bottle labels and comes in contact with water-base adhesives.

A still further improvement of the paper according to the invention is achieved if the moisture absorption is reduced by means of a preparation made from a wax or paraffin dispersion applied to the back of it. Such a preparation is applied preferably in an amount of 1 to 2.5 g/m$^2$. With such a preparation the Cobb number by which water absorption is determined can be established in a range from 7 to 12 g/m$^2$ for a period of 60 seconds. Reducing the moisture absorption of the back is also advantageous if the paper according to the invention, metalized or unmetalized, is used as a label to be adhered with aqueous cements. It has also proven advantageous to such applications to use a raw paper that is sized in the mass and wet-strength furnished and which has a relative wet strength of about 20 to 35 %. This is especially advantageous if the paper is used to manufacture labels which are glued to returnable bottles.

To improve opacity in papers according to the invention which are not to be metalized, a raw paper to which 2 to 3 wt. % of titanium dioxide has been added as a composition additive has proven to be especially suitable.

The following examples will serve for the further explanation of the invention.

EXAMPLE 1

A wood-free raw paper with a substance of 59 g/m$^2$ is prepared by adding to the fiber material resin and alum, a melamine formaldehyde resin as wet-strength agent, and a mixture of kaolin and titanium dioxide to establish an ash content totaling 8 weight-percent.

The back of the paper is treated with a paraffin dispersion containing carboxymethyl cellulose in a mass per unit area of 2.5 g/m$^2$.

To form a coating, a layer of the composition given below is applied to this raw paper:

| |
|---|
| 80 weight-parts of kaolin |
| 20 weight-parts of chalk |
| 100 weight-parts of pigment |

With respect to the pigment content, the composition contains:

1.5 weight-parts of carboxymethyl cellulose 11 weight-parts of a copolymer on a butadiene-styrene base copolymer applied from an aqueous suspension 0.8 weight-parts of a wetproofing agent on an epichlorhydrin base.

After drying the coating applied in a substance per unit area of 12 g/m$^2$ the paper web is passed through a supercalender and the coating then has a Bekk smoothness of 865 s. The air permeability of the calendered paper amounts to 6,920 s, measured by the Gurley method.

For the formation of a cover coat, in the cast coating process, a composition is then applied to this coating which, reckoned as parts by dry weight, is composed as follows:

25 weight-parts of casein 25 weight-parts of a copolymer of vinyl acetate and acrylic acid ester containing carboxyl groups 50 weight-parts of a copolymer based on butadiene-styrene.

The formation of this cover coat is performed with a specific weight of 5 g/m$^2$.

Gloss measurement of the cover coat shows (data in %):

Lengthwise: 96

Crosswise: 96.4

Remeasuring the gloss after performing a labeling test using water-based adhesives shows a virtually complete preservation of the gloss:

Lengthwise: 94.8

Crosswise: 96.4

In an experiment simulating conditions in bottle labeling, in a brewery for example, in a so-called "sweat box," in which condensate moisture is produced on the labeled bottle, the following gloss measurements were then obtained:

Lengthwise: 86.1

Crosswise: 90.5

Comparative gloss measurements on commercially available cast coated papers in the original state show lower glosses than the papers of the invention, according to the experiments described above.

| | Lenghtwise | Crosswise |
|---|---|---|
| Comparative sample 1 | 84 | 87 |
| Comparative sample 2 | 86 | 90 |
| Comparative sample 3 | 84 | 87 |

Testing a sample printed by the flexoprinting method for printing ink adherence according to the Applicant's own method, after watering for 10 minutes, on a six-point scale in which 1 corresponds to good and 6 to poor, resulted in a printing ink adherence rating of 1.

The test for the Cobb value performed on the back of the paper results in a value of 9 g/m$^2$ every 60 seconds.

EXAMPLE 2

On the cover coat of the paper described in Example 1, a thin metal coating of great uniformity and very high brilliance was produced by the vacuum depositing method.

EXAMPLE 3

An unsized, neutral-run raw paper containing 40 wt. % of mechanical wood pulp with a substance of 90 g/m$^2$ is produced, which is provided with two coatings one over the other. For that purpose the coatings specified below are applied with the doctor blade:

Coating a 100 wt.-parts ground chalk 14 wt.-parts binding agent consisting of: 7 wt.-parts enzymatically degraded starch, and 7 wt.-parts of a butadiene-styrene copolymer, Coating b 80 wt.-parts kaolin 20 wt.-parts ground chalk 3 wt.-parts of a synthetic thickening agent 8 wt.-parts of a butadiene-styrene copolymer.

Coating a is applied at the rate of 10 g/m$^2$, coating b at a rate of 12 g/m$^2$. After drying coating b the paper is calendered in a supercalender, and then has a Bekk smoothness of 2,300 s.

Then the following composition was applied to the coating by cast coating:

50 wt.-parts casein 25 wt.-parts of a copolymer of vinyl acetate and polyacrylic acid ester containing carboxyl groups, 25 wt.-parts of a butadiene-styrene copolymer.

This cover coat is applied at a rate of 3.5 g/m$^2$. After the equalization of the composition for making the cover coat, the paper web is brought in contact with a heated high-gloss cylinder and the composition is dried to form the cover coat. A gloss of 96% is measured.

EXAMPLE 4

The procedure of Example 1 is followed, but with the difference that the composition for forming the cover coat also contains 5 wt. % of titanium dioxide with respect to the binding agent content of the cover coat composition. The opacity is visibly improved, but the gloss is about 10% less than in Example 1.

EXAMPLE 5

The procedure is as in Example 4. Instead of titanium dioxide, however, satin white is used, thereby achieving a hardening of the casein. A gloss measurement, performed after the experiment described in Example 1 for simulating conditions in bottle labeling (sweat-box test)- shows a gloss loss of only 1 to 2%.

All data on the individual compositions and application weights are to be understood to refer to parts by dry weight.

I claim:

1. A one-side coated paper comprising a calendered coating applied to one side of raw paper, said coating consisting of one or two layers formed with a composition containing a first film-forming synthetic resin binding agent, a natural binding agent and a mineral pigment, a cover coat applied to said calendered coating by the cast coating method using a mineral pigment-free composition containing a second film-forming synthetic resin binding agent and a natural binding agent, said second film-forming synthetic resin binding agent having a film-forming temperature of less than 40° C., and said mineral pigment-free composition containing from 20 to 60 wt. % of a natural binding agent, based on the total binding agent content.

2. A one-side coated paper of claim 1, wherein the cover coat contains from 32 to 45 wt. % of natural binding agent.

3. A one-side coated paper of claim 1, wherein said calendered coating has a Bekk gloss of at least 150 s.

4. A one-side coated paper of claim 3, wherein the calendered coating has a Bekk gloss of 500 to 3,000 s.

5. A one-side coated paper of claim 1, wherein the air permeability of the calendered paper, measured before application of the cover coat, is no more than 9,000 s.

6. A one-side coated paper of claim 1, wherein said calendered coating has a surface mass of at least 5 g/m$^2$.

7. A one-side coated paper of claim 6, wherein said calendered coating has a surface mass of 7 to 22 g/m$^2$.

8. A one-side coated paper of claim 1, wherein said cover coat has a surface mass of no more than 10 g/m$^2$.

9. A one-side coated paper of claim 8, wherein said cover coat has a surface mass of 3 to 8 g/m$^2$.

10. A one-side coated paper of claim 1, wherein said cover coat has a gloss of 88 to 98%, measured at an angle of 75° by the Lehmann method.

11. The process for the production of a one-side coated paper, which comprises applying to raw paper one or two layers of a composition containing a film-forming synthetic resin binding agent, a natural binding agent and a mineral pigment, drying said coating, calendering said dry coating, and applying to said calendered coating by the cast coating method a mineral pigment-free cover coat composition containing a film-forming synthetic resin having a film-forming temperature below 40° C. and 20 to 60 wt. % of a natural binding agent, based on the total binding agent content.

* * * * *